US006216280B1

(12) United States Patent
Rabe

(10) Patent No.: US 6,216,280 B1
(45) Date of Patent: Apr. 17, 2001

(54) OVERGARMENT WITH MOBILE TELEPHONE POCKET

(76) Inventor: Jürgen Rabe, Sterpersdorfer Mohle D-91315, Höchstadt (DE)

( * ) Notice: Subject to any disclaimer, the term of this patent is extended or adjusted under 35 U.S.C. 154(b) by 0 days.

(21) Appl. No.: 09/424,249

(22) PCT Filed: May 29, 1999

(86) PCT No.: PCT/DE98/01481

§ 371 Date: Nov. 30, 1999

§ 102(e) Date: Nov. 30, 1999

(87) PCT Pub. No.: WO98/53714

PCT Pub. Date: Dec. 3, 1998

(30) Foreign Application Priority Data

May 30, 1997 (DE) ..... 297 09 433 U

(51) Int. Cl.[7] ..... A41D 1/00
(52) U.S. Cl. ..... 2/247; 2/69; 2/94
(58) Field of Search ..... 2/247–251, 69, 2/69.5, 79, 80, 85, 95, 94, 93, 105–108, 113–115

(56) References Cited

U.S. PATENT DOCUMENTS

| | | | | |
|---|---|---|---|---|
| 4,087,864 | * | 5/1978 | LaBove et al. | 2/102 |
| 4,825,471 | | 5/1989 | Jennings . | |
| 4,876,724 | * | 10/1989 | Suzuki | 381/187 |
| 4,910,802 | * | 3/1990 | Malloy | 2/69 |
| 5,101,515 | * | 4/1992 | Holt et al. | 2/94 |
| 5,247,707 | * | 9/1993 | Parker et al. | 2/102 |
| 5,611,085 | * | 3/1997 | Rasmussen | 2/102 |
| 5,717,999 | * | 2/1998 | Lurry | 2/69 |
| 5,774,338 | * | 6/1998 | Wessling, III | 361/730 |
| 5,890,227 | * | 4/1999 | Brown | 2/102 |

FOREIGN PATENT DOCUMENTS

| | | |
|---|---|---|
| 296 22 842 | 10/1997 | (DE) . |
| 2 213 753 | 8/1974 | (FR) . |
| 2 345 957 | 10/1977 | (FR) . |
| 1 479 173 | 7/1977 | (GB) . |

* cited by examiner

*Primary Examiner*—Gloria M. Hale
(74) *Attorney, Agent, or Firm*—Nixon Peabody LLP; David S. Safran

(57) ABSTRACT

The aim of the invention is to produce an overgarment (1) with a pocket (2) in such a way that a pocket mobile telephone (3) can easily be placed in said pocket (2) and is prevented from falling out of the pocket when the wearer is bending down or walking quickly. To this end, the size of the pocket (2) is configured for carrying a mobile telephone (3) and at least one holding strap (8, 14) is provided on the overgarment (1). Said holding strap is attached on the pocket (2) or in the pocket area and at the waist (11) or in the waist area (11.1), running either directly to the waist (11) waist area (11.1) or via the shoulder (10).

20 Claims, 1 Drawing Sheet

OVERGARMENT WITH MOBILE TELEPHONE POCKET

BACKGROUND OF THE INVENTION

1. Field of the Invention

This invention relates to an overgarment such as a shirt, coat, vest of the like with a pocket.

In such overgarments, especially shirts, coats, vests or the like there are generally breast pockets into which the owner of a mobile telephone inserts it in order to be able to make or receive calls at any time. Normally, the pockets are relatively wide so that when bending, running or the like the mobile telephone can slip out of the breast pocket. In other versions, the pocket is so narrow that a mobile telephone cannot be inserted into it. Another disadvantage. preferably of light, for example summer or for example silk, overgarments, is that with the mobile telephone inserted the overgarment is more or less strongly stretched out of shape.

2. Description of Related Art

The object of this invention is to avoid the aforementioned unwanted effects in an overgarment of the indicated type.

SUMMARY OF THE INVENTION

This object is achieved by the size of the pocket being designed for insertion of a mobile telephone, and on the overgarment, there being at least one holding strap which, on the one hand, is attached on or in the area of the pocket, and on the other hand, runs directly or over the shoulder to the waist or the area of the waist, especially underneath the waist.

With the invention both easy insertion of the mobile telephone into the pocket is ensured and also its slipping out during bending or running and distortion of the overgarment are reliably prevented.

Other advantageous details of the invention are described below using the embodiments illustrated in the drawings.

DETAILED DESCRIPTION OF THE PREFERRED EMBODIMENTS

Figure 1:
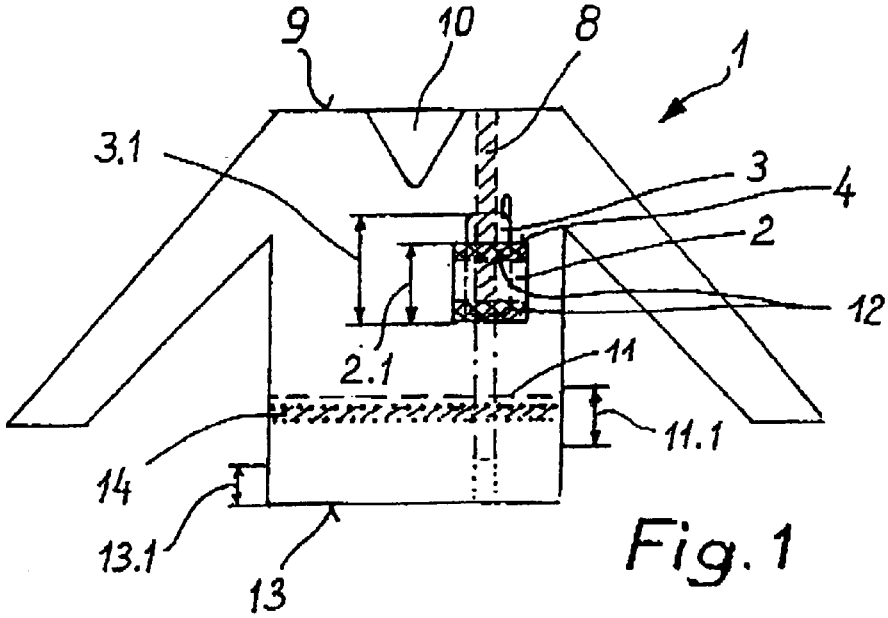
FIG. 1 shows an overgarment with a breast pocket.

In FIG. 1 the overgarment 1 is labeled 1; it has a pocket 2, which is made as a side breast pocket. The pocket 2 is made such that a mobile telephone 3 has enough room anytime. The depth 2.1 of the pocket 2 is at least 70% of the length 3.1 of the mobile telephone 3 and the cross section of the pocket 2 is matched or can be matched to that of the mobile telephone such that it is held relatively securely in the pocket 2 or can be arranged securely by closures so that it does not fall out during bending or when running.

Figure 3:
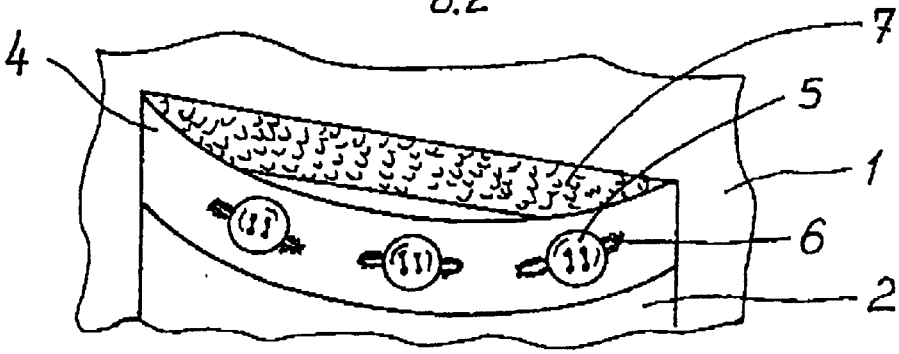
FIG. 3 shows a pocket with preferred closures.

The closure is, for example, a row of buttons provided on the upper edge 4 of the pocket 2 consisting of several buttons 5 located next to one another, but spaced apart, and the pertinent buttonholes 6, as is shown in FIG. 3. Instead of a row of buttons or also in addition to it, there can be a velcro closure 7 as the closure, of which only one closure part is visible.

From the pocket 2, which is made in FIG. 1 as the breast pocket, a shoulder strap 8 leads from the pocket 2 over the shoulder 9 and the back 10, which is not visible, as far as the waist 11 or the area 11.1 of the waist 11, as is shown by the broken line in FIG. 1. In particular the shoulder strap 8 extends to underneath the waist 11. This ensures that when a belt is worn, for example, of the overgarment 1 itself, trousers or the like, the overgarment 1 on the back 10 is not pulled up or out from the pants or a skirt when a mobile telephone is placed in the pocket 2.

The shoulder strap 8 is attached at least on or in the area of the pocket 2 and on or in the area 11.1 of the waist 11 on the back of the overgarment 1. It can be attached at points, in segments or over its entire length to the overgarment 1, especially sewn on, riveted on or the like. The shoulder strap 8 can be provided on the inside or outside or it can be attached on the inside and on the outside. The shoulder strap 8 or straps can be made in one or more layers. The shoulder strap 8 can be routed on the back 10 as far as the lower edge 13 of the area 13.1 of lower edge 13 and attached there.

Preferably the pocket 2 is provided, at least in the area of the attachment of the shoulder strap 8, with a reinforcement 12, for example, a nonwoven backing, with a cloth spot or the like attached externally, as is shown by the crosshatching in FIG. 1.

According to another embodiment of the invention, two or more narrow shoulder straps 8 can be attached adjacently or next to one another at a distance.

In addition there can be a waist belt 14 which is connected at least on the back 10 to the shoulder strap 8, as is apparent from the broken line in FIG. 1.

Figure 2:
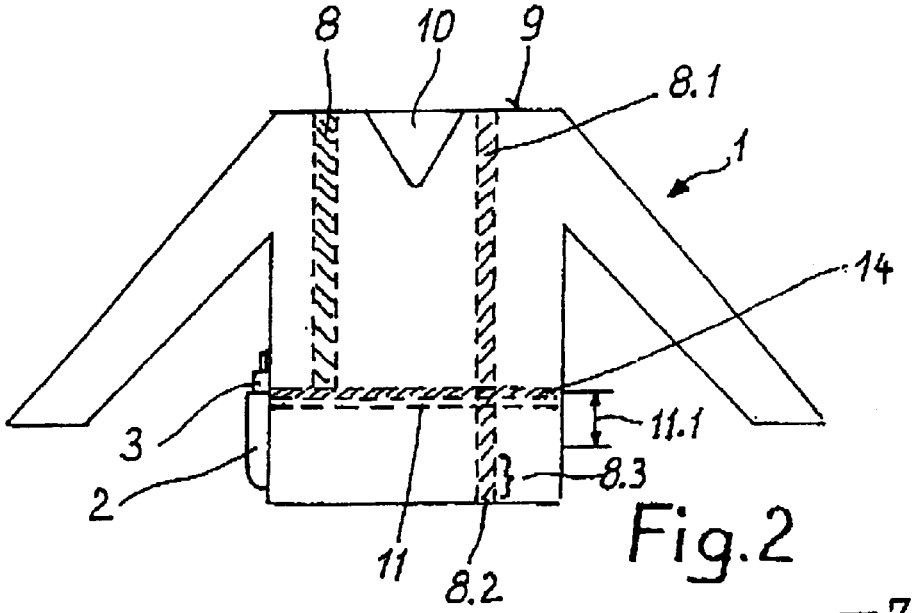
FIG. 2 shows an overgarment with a side pocket.

In the embodiment which is shown in FIG. 2 the pocket 2, is made as a side pocket. It can be attached in an area laterally forward to laterally to the back, for example, in the area of a back pocket which present on trousers, at the height of the waist 11. The side pocket 2 is connected to the waist belt 14 or can be attached to it. The waist belt 14 is feasibly adjustable or variable in its width.

In addition, on the side of the side pocket, a shoulder strap 8 can be attached. Preferably it is or can be permanently connected to the waist belt 14 on the front and back. Feasiblely, the shoulder belt 8 is adjustable in its length.

Optionally, it is advantageous to provide straps in the form of a shoulder holster.

It can also be feasible when using a side pocket 2 to attach a shoulder strap 8.1 identical or similar to the first one on one side of the overgarment 1 and also on its other side. The shoulder strap 8.1 is permanently connected at least with its end 8.2 or its end area 8.3 to the overgarment 1. The shoulder strap 8.1 can also, as in the embodiment according to FIG. 1, be attached to the waist belt 14. Furthermore, there can be a second pocket 2 or several additional pockets 2, for example, a breast and a side pocket, two breast pockets or two side pockets or the like. In this way, the overgarment 1 can be used equally well, for example, for left-handers and right-handers or the one-handed.

It is also fundamentally possible to attach the shoulder strap 8 and/or the pocket 2 against the representation in FIG. 1 on the side of the overgarment 1 which is the right in the front view.

What is claimed is:

1. An overgarment comprising:

a waist;

a pocket of a size and shape for receiving a mobile telephone therein; and at least one holding strap attached in an area of the pocket and an area of the waist, said at least one holding strap extending over a shoulder area of said overgarment to an area underneath the waist, wherein said pocket includes an opening area having means for matching at least one of a maximum cross section and a width of said opening area to a transverse cross section of a variety of different mobile telephone to securely hold the mobile telephone while stored in said pocket.

2. Overgarment as claimed in claim 1, wherein said means for matching comprises at least one closure.

3. Overgarment as claimed in claim 2, wherein said at least one closure is a flapless closure.

4. Overgarment as claimed in claim 2, wherein the flapless closure has buttons which are spaced from one another and have a respective buttonhole.

5. Overgarment as claimed in claim 2, wherein the flapless closure is a hook and loop type closure provided in an area of an upper edge of the pocket.

6. Overgarment as in claim 1, wherein the pocket has a depth which corresponds approximately to at least 70% of a length of the mobile telephone.

7. Overgarment as in claim 1, wherein the pocket is a breast pocket and the at least one holding strap is a shoulder strap which extends from the pocket rearwardly over a shoulder of the overgarment and down a back of the overgarment at least as far as the waist.

8. Overgarment as claimed in claim 7, wherein the shoulder strap extends on the back at as far as an area of a lower edge of the overgarment.

9. Overgarment as claimed in claim 7, wherein the shoulder strap is attached, at least in points or segments, at least in the area of the pocket and in the area of the waist.

10. Overgarment as claimed in claim 7, wherein there is a waist belt which can which is securely joinable to the shoulder strap on the back.

11. Overgarment as claimed in claim 1, wherein the pocket is a side pocket which is located in a lateral peripheral area near the waist, and wherein a waist belt is attached in the area of the side pocket.

12. Overgarment as claimed in claim 11, wherein a shoulder strap is connected on a side of the side pocket, the shoulder belt being connectable to the waist belt.

13. Overgarment as claimed in claim 12, wherein the should and waist straps form a shoulder holster.

14. Overgarment as claimed in claim 1, wherein a shoulder strap is provided on a side of the overgarment furthest from the pocket, the shoulder strap running at least from the waist on the front of the overgarment to the waist on the back of the overgarment and being attached at least at end areas thereof to the overgarment.

15. Overgarment as claimed in claim 1, wherein the pocket is provided with a reinforcement.

16. Overgarment as claimed in claim 15, wherein the reinforcement is a nonwoven backing.

17. Overgarment as claimed in claim 15, wherein the reinforcement is comprised of several layers.

18. Overgarment as claimed in claim 1, wherein the holding strap comprises a plurality of layers.

19. Overgarment as claimed in claim 1, wherein the holding strap is attached on the overgarment.

20. Overgarment as claimed in claim 1, wherein the overgarment comprises an outer material and an inner lining and the holding strap is disposed between the outer material and said inside lining.

* * * * *